US007658415B2

(12) United States Patent
Hironaka

(10) Patent No.: US 7,658,415 B2
(45) Date of Patent: Feb. 9, 2010

(54) SCRAPBOOK HAVING SCENTED PAGES

(76) Inventor: Robin S. Hironaka, 1092 N. Grove Dr., Alpine, UT (US) 84004

( * ) Notice: Subject to any disclaimer, the term of this patent is extended or adjusted under 35 U.S.C. 154(b) by 702 days.

(21) Appl. No.: 11/068,304

(22) Filed: Feb. 27, 2005

(65) Prior Publication Data

US 2006/0202466 A1 Sep. 14, 2006

(51) Int. Cl.
*B42D 1/08* (2006.01)

(52) U.S. Cl. ..... 281/22; 281/51; 402/79

(58) Field of Classification Search ..... 281/22, 281/29, 38, 51; 428/905; 239/34, 37, 57, 239/59; 402/79, 80 P; 383/100, 101, 102, 383/103, 113

See application file for complete search history.

(56) References Cited

U.S. PATENT DOCUMENTS 3,613,678 A * 10/1971 Mayhew ..... 128/206.19
4,484,768 A * 11/1984 Norfleet ..... 283/116
4,516,871 A * 5/1985 Leitman ..... 402/79
4,909,438 A * 3/1990 Viti ..... 239/34
5,018,974 A * 5/1991 Carnahan et al. ..... 434/98
5,492,705 A * 2/1996 Porchia et al. ..... 426/106
5,634,667 A * 6/1997 Jordan ..... 281/29
6,164,444 A * 12/2000 Bray et al. ..... 206/268
2001/0035644 A1* 11/2001 Amadeo ..... 281/31
2002/0051675 A1* 5/2002 Nomura ..... 402/70

FOREIGN PATENT DOCUMENTS

JP 2000118178 A * 4/2000
JP 2001118178 A * 4/2001

* cited by examiner

*Primary Examiner*—Dana Ross
*Assistant Examiner*—Pradeep C Battula
(74) *Attorney, Agent, or Firm*—Angus C. Fox, III

(57) ABSTRACT

A scrapbook, in which multiple fragrances associated with memorable events can be stored for extended periods of time, includes scented pages enclosed in perforated see-through protector sleeves, diffusion barrier sheets bound between adjacent pages having dissimilar fragrances, a diffusion barrier sheet bound between a front cover of the scrapbook and the first scented page, and a diffusion barrier sheet bound between a back cover of the scrapbook and the last scented page. The protector sleeves, which control the release of fragrance from paper sheets to which a fragrance has been applied, are fabricated from polymeric films, such as polypropylene, which have excellent resistance to oils and gases. Barrier sheets may be metalized for enhancement of diffusion barrier qualities. Fragrances may be applied to scrapbook paper by spraying, rolling, painting, stamping, printing or immersion.

11 Claims, 7 Drawing Sheets

SCRAPBOOK HAVING SCENTED PAGES

BACKGROUND OF THE INVENTION

1. Field of the Invention

This invention relates to scrapbooks, fragrance impregnated paper, and diffusion barriers for volatile aromatic compounds.

2. Description of the Prior Art

Paper has long been used as a substrate for fragrances. Many examples of paper-based air fresheners are readily available in commerce. Because fragrances, by their very nature, are volatile compounds. Without some type of containment, they evaporate rapidly into the atmosphere. In addition, multiple fragrances in close proximity tend to mix and lose their individuality.

During the past several decades, the hobby of scrapbooking has become increasingly popular. The popularity has spawned an entire industry dedicated to fulfilling the needs of scrapbooking hobbyists. Scrapbooks are typically glorified photo albums dedicated to recording and preserving events of interest, as well as personal and family histories. The detail, complexity and ornateness of scrapbooks is limited only by the hobbyist's imagination. The compilation of a single ornate scrapbook can represent the expenditure of many hundreds of hours of time and many hundreds of dollars.

Memories of a particular event or a particular series of related events generally involve all of the senses: sights, sounds and smells. There is a trend in scrapbooking that attempts to memorialize events in ways that they will be well remembered. The manipulative creativity that accompanies digital photography has certainly enhanced the sight aspect of the recorded memory. Low-power sound chips, such as the multi-level analog sound storage of Winbond Electronics Corporation of America, provide an opportunity to store sound aspects of particular events. Such chips are small enough that they could be incorporated in a playable module stored in a pocket on the pages of a scrapbook and removed for playing. The smells associated with particular events pose certain problems related to storage within a scrapbook. Fragrances, by their very nature, must be volatile compounds so that they can either sublimate or evaporate into the air. Clearly, unless a the compound emanating the fragrance is stored in a sealed container, it will eventually be lost to the atmosphere. In addition, volatile compounds readily diffuse through materials that are porous or have a molecular structure that allows the volatile compound to be absorbed and pass through the material. The diffusion of volatile compounds through materials, such as paper, makes it impossible to store volatile compounds for any length of time, as well as to maintain multiple fragrances stored in close proximity as discrete and separate compounds.

SUMMARY OF THE INVENTION

The present provides a scrapbook in which multiple fragrances associated with memorable events can be stored for extended periods of time. If a particular event is associated with a certain fragrance, that fragrance can be applied to all paper sheets of the scrapbook associated with that event. For example, a camping trip to the mountains might be preserved on pages to which pine or other evergreen fragrance has been applied. Pages for a wedding might use rose fragrance. Sheets of paper pre-impregnated with a particular fragrance may be purchased, or a particular fragrance may be sprayed, rolled, painted, stamped, or printed on the paper. Alternatively, a sheet of paper may be totally immersed in a solvent bath containing the desired fragrance. A barrier sheet is placed between sections of the scrapbook containing different fragrances and at the beginning and end of the scrapbook inside the front and back covers. The use of barrier sheets at the beginning and end of the scrapbook dramatically reduces the surface area from which the fragrance may diffuse and evaporate into the atmosphere, thereby greatly prolonging the storage life of the fragrance. If each of the paper sheets within the scrapbook is not enclosed in a page protector, then with the use of barrier sheets, the only escape path available to the stored fragrances during storage is through the edges of the paper. Rapid evaporation of the volatile fragrance compounds occurs only when a particular page is open and the entire surface is exposed to the atmosphere. The barrier sheets may be any polymeric film or laminar sheet which has a resistance to oils and other chemicals. In order to enhance the barrier qualities of the polymeric films, a metal layer may be deposited on the films. Because of its low cost, aluminum is the preferred deposition metal. Polypropylene provides an excellent barrier to oils and gases, as does polyethylene terephthalate. Aluminized films made from the latter compound, also known as polyester or Mylar®, are readily available. Polyethylene and polyvinyl chloride are two additional materials which may be used for barrier films.

In order to further control the release of fragrance that has been applied to sheets of paper, each of those paper sheets is enclosed in a see-through page protector having a basic shape similar to those in notorious use in the scrapbooking industry. See-through page protectors, which look like plastic sleeves and are made from transparent polymeric plastic films, are such an integral part of scrapbooking that many manufacturers include them in the purchase prices of their album systems. One scrapbook page (finished on both sides), or two back-to-back pages, can be slipped into a single page protector. Like the albums, page protectors come in many sizes, from 4 inches×5 inches to 12 inches×15 inches, and even larger. A very popular size is probably 12 inches×12 inches.

Other than size, page protectors are generally available having a single option selected from each of the following four groups:

- Type of film—The polymeric films from which they are manufactured include polypropylene, polyethylene, polyester (Mylar®), and plasticized polyvinylchloride ("vinyl");
- Finish—Gloss or mat finish;
- Loading—Top-loading or side-loading; and
- Binding—Standard post-bound, three-ring, or strap-hinge types.

Page protectors fabricated from polypropylene films are widely used in the scrapbooking industry, as they are relatively inexpensive, have excellent transparency, and are tough and long-lasting. Regardless of the material from which it is made, a page protectors are typically fabricated from a sheet of polymeric material that is folded back on itself to create a double layer assembly that is subsequently heat sealed around the non-folded edges to form an envelope or sleeve. The loading slit is placed along the top or side edge. For the present invention, the page protectors are fabricated from the same polymeric materials as those used for the barrier sheets, with the exception that they are not metalized. Both sides of the page protector has a plurality of small fragrance release perforations, which are of sufficient number and size to permit a controlled escape of the fragrance when the major surface of the sheet. Preferably, the perforations are punched or stamped through both sheet layers simultaneously, removing the chads, and leaving an unperforated border that is about 1 to 3 centimeters in width. It should be understood that a greater number of smaller perforations is preferred to a smaller number of larger perforations, as greater protection is thus afforded to the page stored within the protector sleeve. An evenly-spaced array of circular perforations of up to 1 millimeter in diameter is deemed to be the currently preferred embodiment.

The use of page protectors having sealed edges greatly increases the time period during which fragrances may be effectively stored within a scrapbook. Only when a page is open is there direct exposure of a fragrance-impregnated page through the individual perforations, as the page protector is sealed around the edges. If the page protector is designed so that the loading slit is covered with a flap, the individual perforations are the only escape route for volatile aromatic compounds. Alternatively, the loading opening can be heat sealed after a page is inserted within the page protector sleeve. The preferred shape of the fragrance release perforations is circular, as there is no stress point within the perforation that would lead to tearing of the protective sheet. In addition, small round perforations as opposed to oval perforations, for example, provide the greatest protection to the page within the page protector sleeve. However, the preferred use of round perforations is not intended to be limiting.

Fragrances in all odor categories are contemplated for the use in scrapbooking. The following fragrances are listed as only a few of those which are available: fruit fragrances such as strawberry, raspberry, peach, cherry, apple and pear; citrus fragrances such as orange, lemon, grapefruit, and lime; floral fragrances such as rose, magnolia, gardenia, jasmine, blackcurrant, hyacinth, lilac, lily-of-the-valley, calyx, osmanthus, orange blossom, apple blossom, rose, Japanese Yuzu, and freesia; woody fragrances such as cedarwood, sandalwood, oak, and pines; leather fragrances, i.e., dominant scents from the quinoline family; oriental fragrances such as musk, vanillin, laubdanum, and oak moss scents; aldehydic scents; mint fragrances such as spearmint and peppermint; and food fragrances such as vanilla, chocolate, chocolate mint, pizza, popcorn, barbecued meats (beef and chicken).

DETAILED DESCRIPTION OF THE INVENTION

The invention and its method of manufacture will now be described in detail with reference to the attached drawing FIGS. 1 through 7. It should be under stood that the drawings are not necessarily drawn to scale and that they are intended to be merely illustrative.

Figure 1:
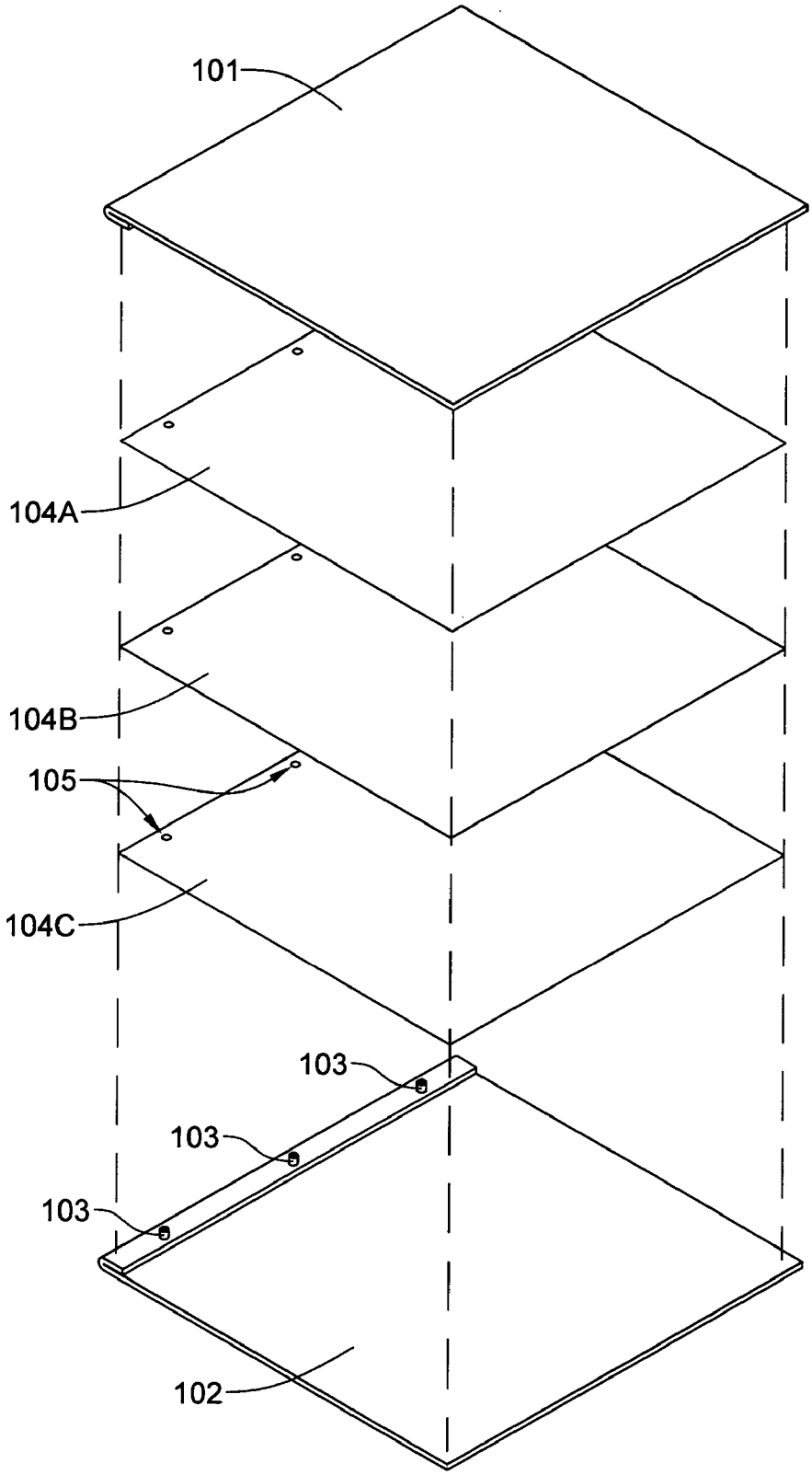
FIG. 1 is an isometric exploded view of a scrapbook binder and multiple diffusion barrier leaves.

Referring now to FIG. 1, a scrapbook assembled in accordance with the present invention, comprises a front cover 101, a back cover 102, a conventional three-post binding system (of which only three female-threaded binding posts 103 associated with the back cover 102, are seen), and multiple diffusion barrier sheets 104A, 104B and 104C. A diffusion barrier sheet 104A is positioned between the front cover and a first page to which a fragrance has been applied. Although the diffusion barrier sheet 104A is positioned adjacent the first scented page, there may be unscented pages between the front cover 101 and the first scented page. The diffusion barrier sheet 104A not only prevents the fragrance from diffusing through the front cover 101, it may also prevent the diffusion of the fragrance into unscented pages. A diffusion barrier sheet 104C is also positioned between the back cover 102 and the last page to which a fragrance has been applied. The use of barrier sheets at the beginning and end of the scrapbook dramatically reduces the surface area from which the fragrance may diffuse and evaporate into the atmosphere, thereby greatly prolonging the storage life of the fragrance.

Figure 2:
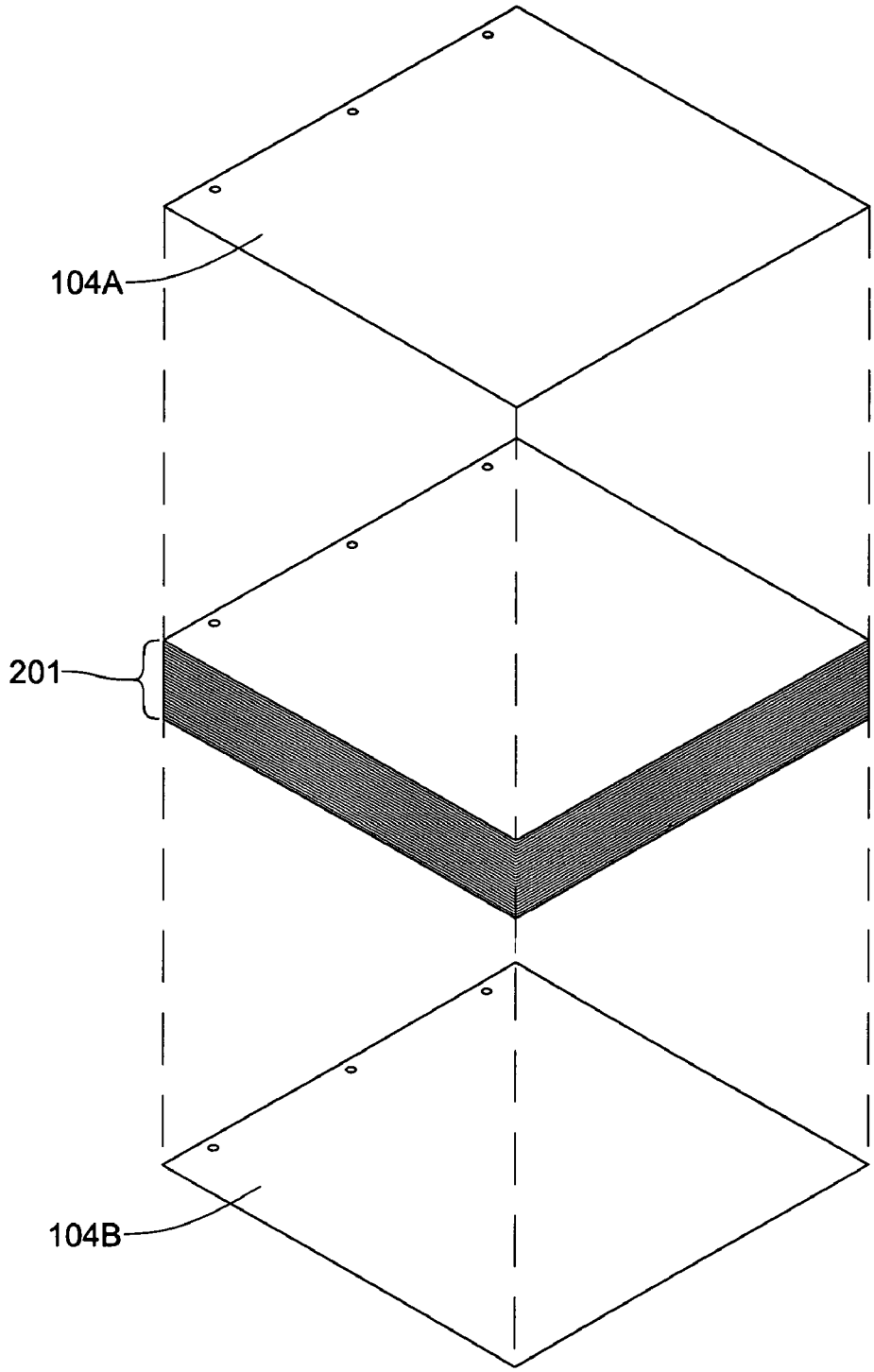
FIG. 2 is an isometric exploded view of a pair of diffusion barrier sheets and a bundle of paper sheets to which fragrance has been applied.

Referring now to FIG. 2, a stack of paper sheets 201 to which a common fragrance has been applied are positioned between diffusion barrier sheets 104A and 104B. The assembly may be bound between front and rear covers 101 and 102. If each of the paper sheets within the scrapbook is not enclosed in a page protector, then with the use of barrier sheets 104A and 104B, the only escape path available to the applied fragrances during storage is through the edges of the paper. Rapid evaporation of the volatile fragrance compounds occurs only when a particular page is open and the entire surface is exposed to the atmosphere. The barrier sheets 104A, 104B and 104C may be any polymeric film or laminar sheet which has a resistance to the absorption of gases, oils and other chemicals. In order to enhance the barrier qualities of the polymeric films, a metal layer may be deposited on the films. Because of its low cost and ready availability, aluminum is the preferred deposition metal. Polypropylene provides an excellent barrier to oils and gases, as do polyethylene terephthalate and polyethylene. Aluminized films made from polyethylene terephthalate (also known as polyester or Mylar®) are readily available. Plasticized polyvinyl chloride is another possibility for a diffusion barrier film.

Three embodiments of paper sheet protectors will now be described. Each of the sheet protectors has an array of perforations which provide for the controlled release of fragrance from an inserted paper page to which the fragrance was previously applied.

Figure 3:
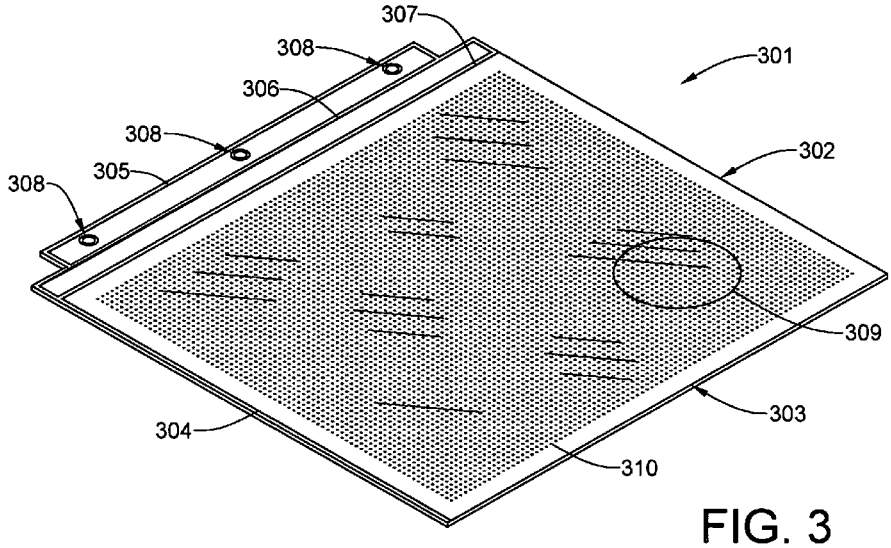
FIG. 3 is an isometric view of the front side of a top-edge-loading transparent protective cover having controlled-release apertures.

Referring now to FIG. 3, a first embodiment paper sheet protector 301 is generally rectangularly shaped and is loadable along a top edge 302. Although the first embodiment sheet protector 301 may be fabricated in a number of ways, this particular example has been fabricated by folding a transparent polymeric sheet along a front edge 303, and heat sealing the folded sheet at seams 304, 305, 306, 307, and around the three binding holes 308. The folded polymeric sheet is not sealed along the top edge 302, and a paper sheet may be inserted between the folded polymeric sheet layers. Sheet protectors are fabricated from the same polymeric films used for diffusion barrier sheets. Polypropylene, polyethylene terephthalate, and polyethylene are the preferred polymeric materials, with plasticized polyvinyl chloride also a possibility.

Figure 4:
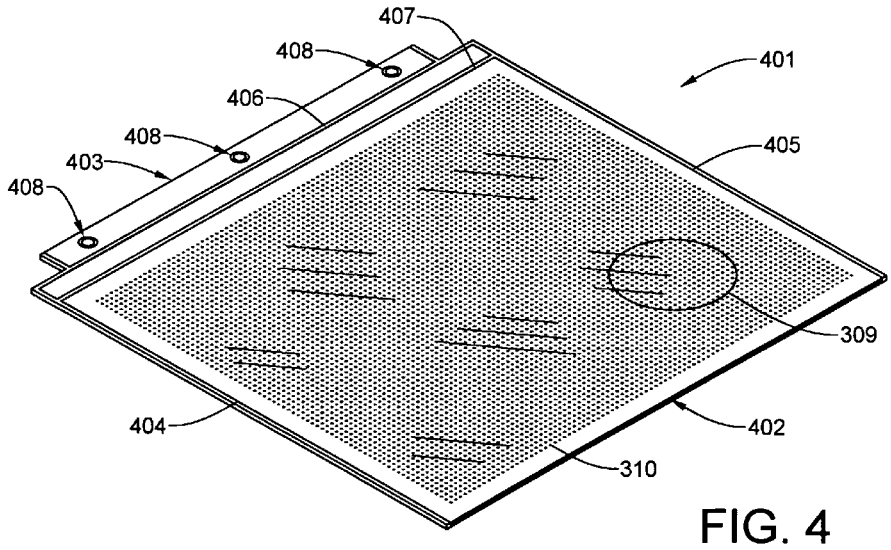
FIG. 4 is an isometric view of the front side of a front-edge-loading transparent protective sleeve having controlled-release apertures.

Referring now to FIG. 4, a second embodiment paper sheet protector 401 is generally rectangularly shaped and is loadable along a front edge 402. This particular example of a front-loadable sheet protector has been fabricated by folding a transparent polymeric sheet along a bottom edge 403 and sealing the folded sheet at seams 404, 405, 406, 407, and around the three binding holes 408. The folded polymeric sheet is not sealed along the front edge 402, and a paper sheet may be inserted between the folded polymeric sheet layers.

Figure 5:
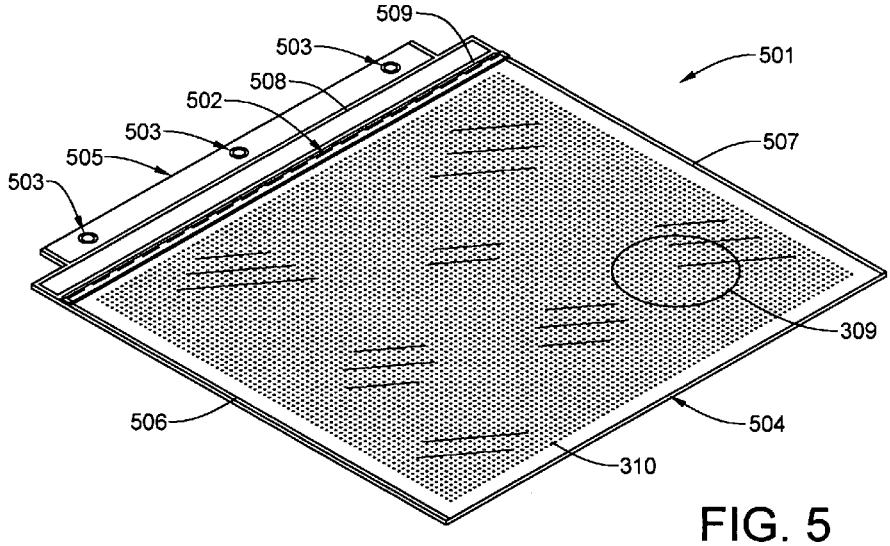
FIG. 5 is an isometric view of the front side of a rear-edge-loading transparent protective sleeve having controlled-release apertures.

Referring now to FIG. 5, a third and preferred embodiment, non-edge-loaded paper sheet protector 501 is generally rectangularly shaped and loadable through a linear opening 502 parallel to and adjacent the binding holes 503. This particular example of a rear-loadable sheet protector has been fabricated by folding a transparent polymeric sheet along a front edge 504 and a rear edge 505. The opening 502 is located where the folded sheet overlaps. Heat sealing is performed at seams 506, 507, 508 and 509. The rear-loadable sheet protector is deemed the preferred embodiment because paper sheets cannot fall out of them once the sheet protector is bound between the front and rear covers 101 and 102, respectively.

Figure 6:
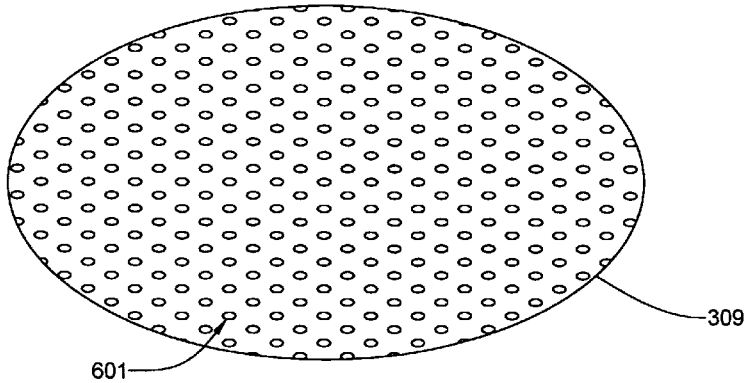
FIG. 6 is a magnified view of region 6 of FIGS. 4, 5 or 6.

Referring now to FIG. 6, region 309 of FIGS. 3, 4 and 5 is a magnified view of the array of perforations 601 which are responsible for the controlled release of fragrance from a paper sheet stored within the sheet protector 301, 401 or 501. The array of perforations 601 is stamped through both layers of the transparent polymeric sheet from which the sheet protector is fabricated. The dashed rectangle 310 of each sheet protector 301, 401 and 501 deliniates the region in which the perforations 601 are punched, leaving a border that is about 1-2 cm wide. Although round perforations 601 are deemed to be the preferred shape, other shaped perforations will also work, though not as well. As drawing FIG. 6 is an isometric view, the circular perforations 601 appear to be oval.

Figure 7:
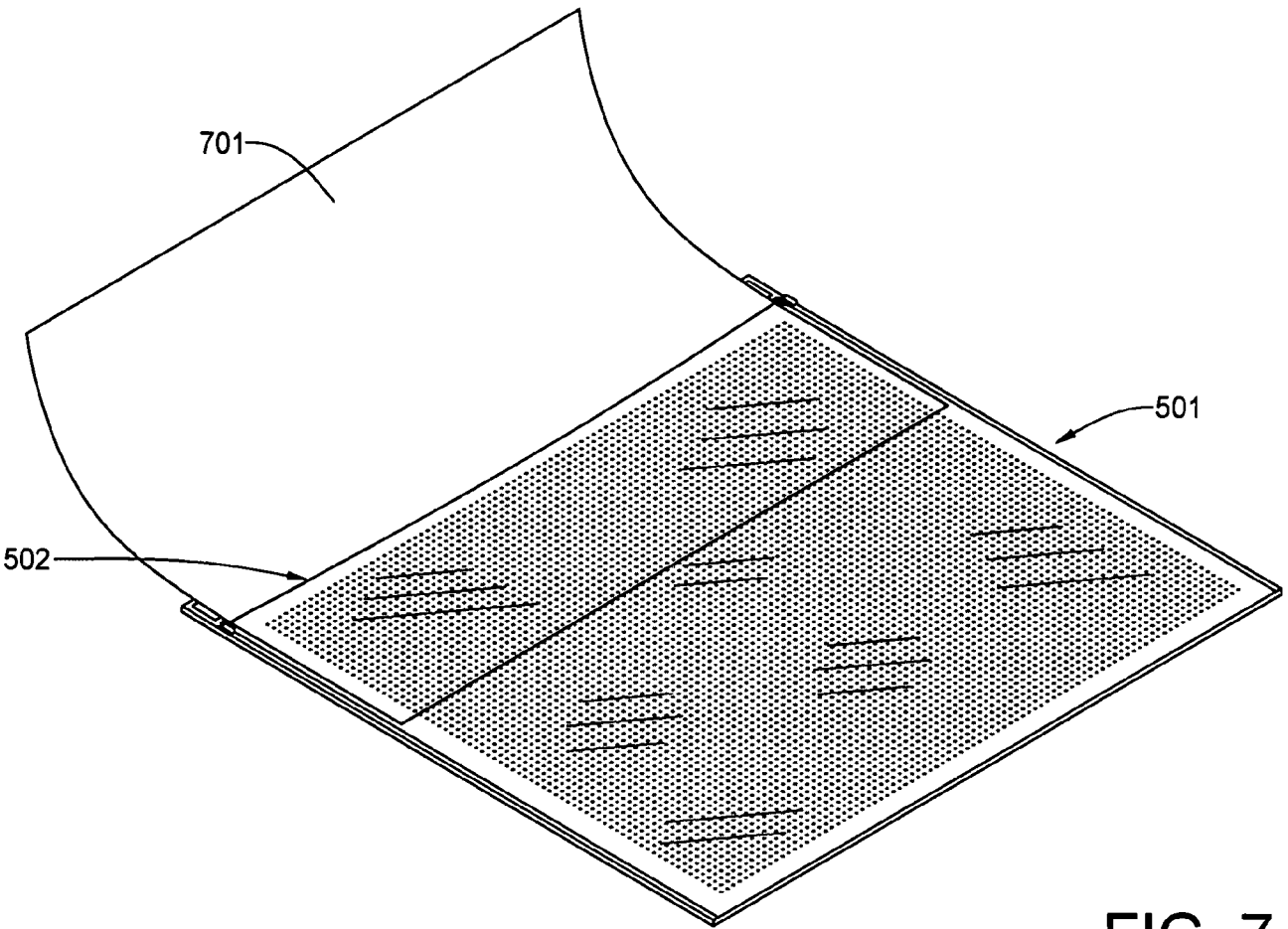
FIG. 7 is an isometric view of a paper sheet being inserted in a rear-edge-loading transparent protective sleeve.

Referring now to FIG. 7, a paper sheet 701 is shown being loaded into sheet protector 501 through opening 502.

Figure 8:
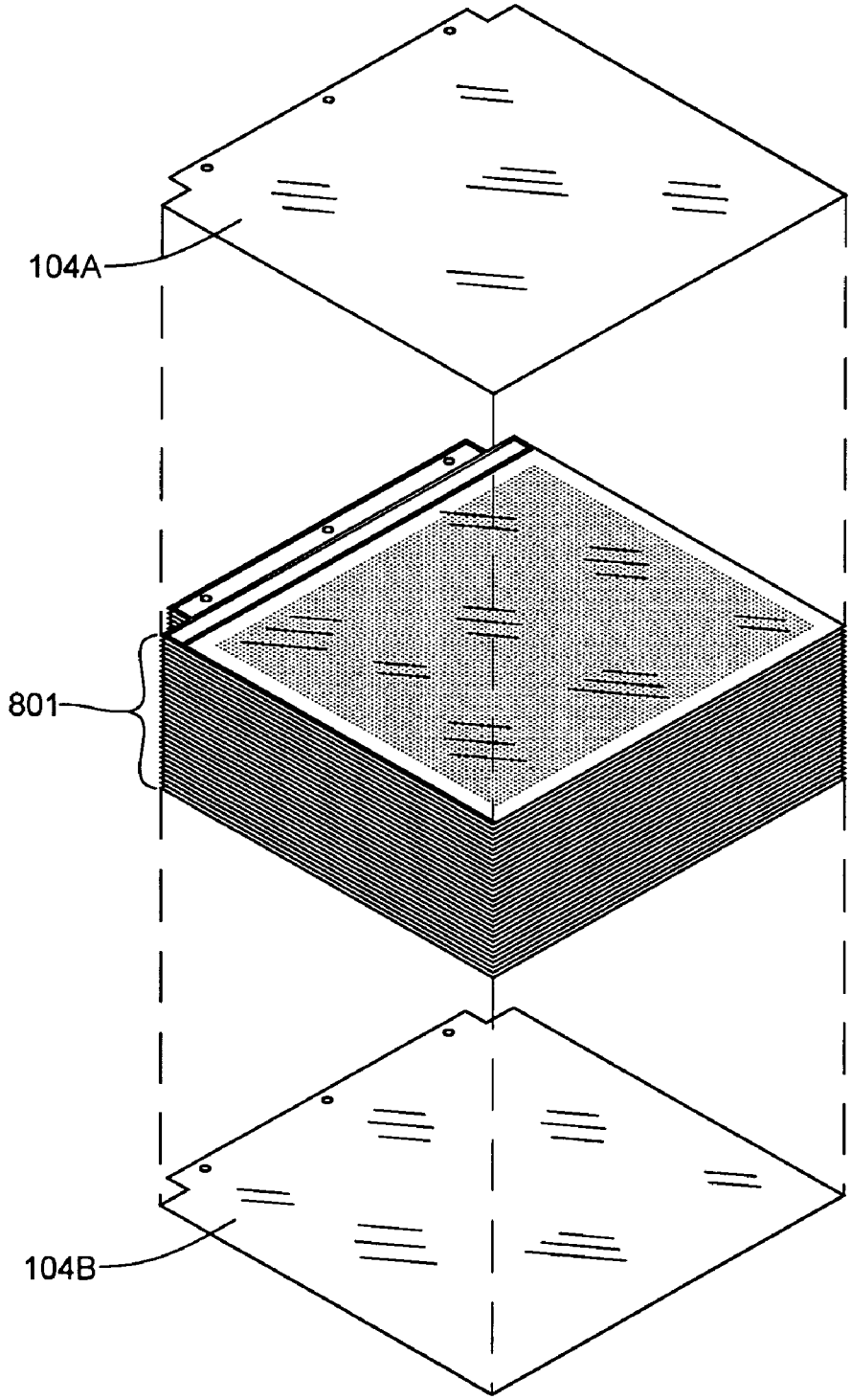
FIG. 8 is an isometric exploded view of a stack of page protector sheets interposed between a pair of diffusion barrier leaves.

Referring now to FIG. 8, a stack 801 of 30 sheet protectors, each of which may contain a paper sheet 701 on which are mounted photographs, decorations, etc., and to which a fragrance has been applied, are shown positioned between a pair of diffusion barrier sheets 104B and 104C. The assembly may be bound between front and rear covers 101 and 102, respectively.

Figure 9:
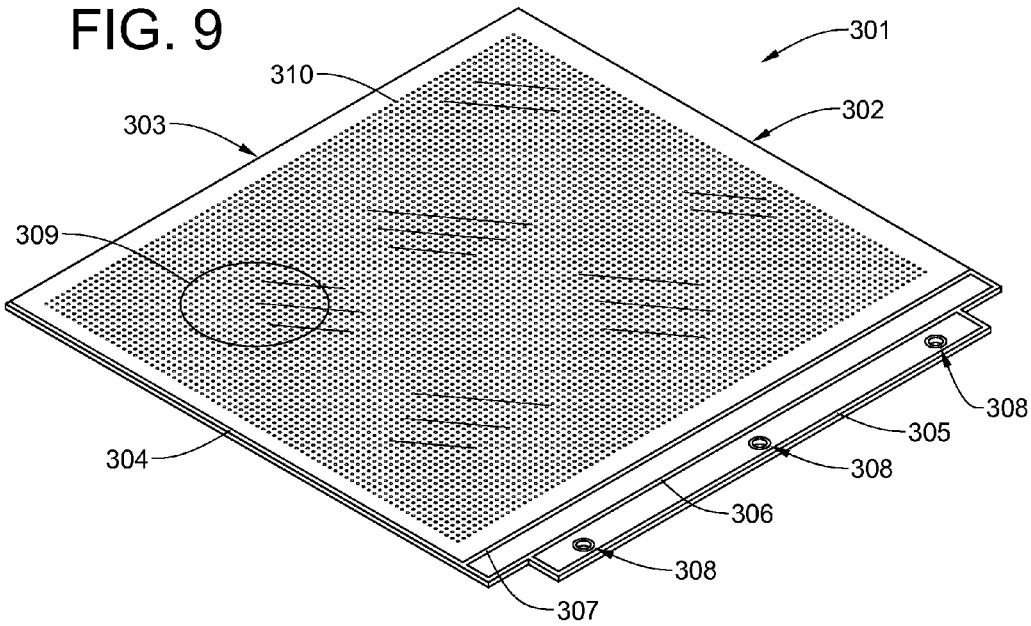
FIG. 9 is an isometric view of the back side of a top-edge-loading transparent protective cover of FIG. 3.

Referring now to FIG. 9, the back side of the top-edge-loading transparent protective cover of FIG. 3 is shown.

Figure 10:
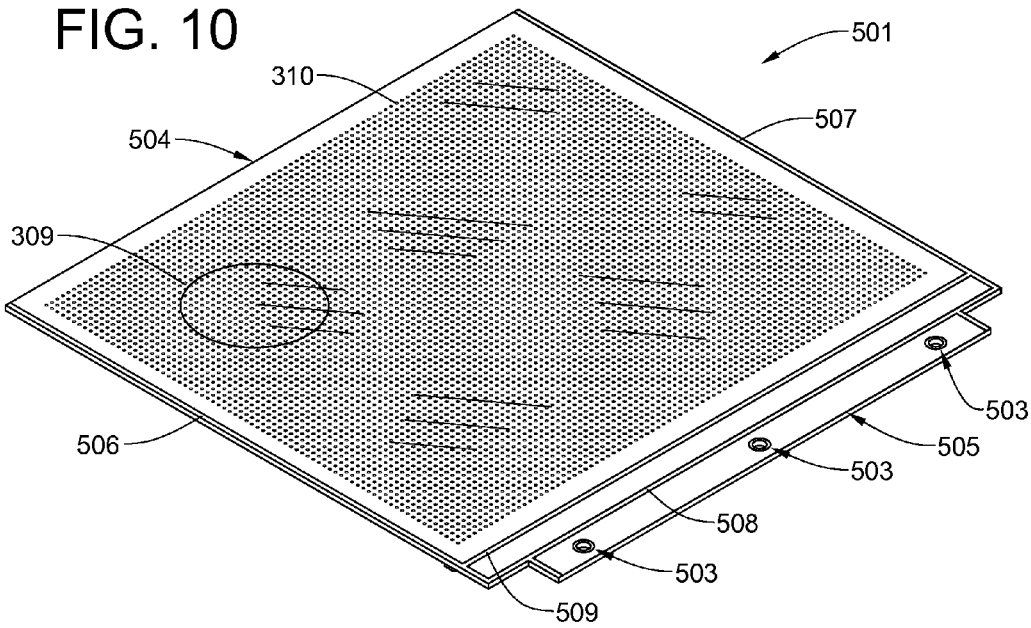
FIG. 10 is an isometric view of the back side of a rear-edge-loading transparent protective sleeve of FIG. 5.

Referring now to FIG. 10, the back side of the rear-edge-loading transparent protective sleeve of FIG. 5 is shown.

Fragrances in all odor categories are contemplated for the use in scrapbooking. The following fragrances are listed as only a few of those which are available: fruit fragrances such as strawberry, raspberry, peach, cherry, apple and pear; citrus fragrances such as orange, lemon, grapefruit, and lime; floral fragrances such as rose, magnolia, gardenia, jasmine, blackcurrant, hyacinth, lilac, lily-of-the-valley, calyx, osmanthus, orange blossom, apple blossom, rose, Japanese Yuzu, and freesia; woody fragrances such as cedarwood, sandalwood, oak, and pines; leather fragrances, i.e., dominant scents from the quinoline family; oriental fragrances such as musk, vanillin, laubdanum, and oak moss scents; aldehydic scents; mint fragrances such as spearmint and peppermint; and food fragrances such as vanilla, chocolate, chocolate mint, pizza, popcorn, barbecued meats (beef and chicken).

Although only several embodiments of the invention have been heretofore described, it will be obvious to those having ordinary skill in the art that changes and modifications may be made thereto without departing from the scope and the spirit of the invention as hereinafter claimed.

What is claimed is:

1. A scrapbook comprising:

front and back covers;

a binding system associated with said covers;

multiple non-edge-loaded protector sleeves bound by said binding system between said covers, each protector sleeve including first and second generally rectangular, stacked sheets formed of a flexible, generally transparent polymeric material, which are sealed along at least three edges to form an envelope into which a scrapbook page may be inserted, each of said sheets having an array of perforations surrounded by an unperforated border that is about 1 to 3 centimeters in width;

multiple paper pages to which a fragrance has been applied, each page being enclosed within a protector sleeve, said fragrance being released from a page being viewed in a controlled manner through said array of perforations;

a first diffusion barrier sheet bound between said covers and positioned between said front cover and a protector sleeve containing a first paper page to which a fragrance has been applied; and a second diffusion barrier sheet bound between said covers and positioned between said back cover and a protector sleeve containing a last paper page to which a fragrance has been applied;

wherein said first and second diffusion barrier sheets are generally impermeable to oils and gases, are devoid of perforations in regions thereof intended to cover perforated regions of a protector sheet, and are fabricated from a material selected from the group consisting of polypropylene, polyethylene terephalate and metal-coated polyethylene terephalate.

2. The scrapbook of claim 1, which further comprises:

a third diffusion barrier sheet, having the same characteristics as said first and third diffusion barrier sheets, bound between said covers and positioned between a pair of protector sleeves, each protector sleeve containing a paper page to which a fragrance has been applied, said fragrances being dissimilar.

3. The scrapbook of claim 2, wherein said protector sleeves and said diffusion barrier sheets are fabricated from polymeric material selected from the group consisting of polypropylene, polyethylene terephthalate, polyethylene and plasticized polyvinyl chloride.

4. The scrapbook of claim 1, wherein said protector sleeves and said barrier sheets are fabricated from polymeric materials that are generally impermeable to both gases and oils.

5. The scrapbook of claim 1, wherein the perforations in each array are generally equidistant from one another, each perforation is circular, and each perforation is generally no greater than 1 millimeter in diameter.

6. The scrapbook of claim 1, wherein aluminum is used to coat the polyethylene terephalate.

7. A scrapbook comprising:

front and back covers;

a page binding system associated with said covers;

multiple fragrance-impregnated paper pages bound between said covers;

at least one non-edge-loaded double layer page protector sleeve having an array of perforations in each of said layers, each of said layers having an unperforated border that is about 1 to 3 centimeters in width, said page protector sleeve being made of flexible, generally transparent polymeric material that is generally impermeable to both gases and oils, said protector sleeve enclosing at least one of the fragrance-impregnated paper pages;

at least one diffusion barrier sheets bound between said covers and positioned between pages which are impregnated with different fragrances; and a diffusion barrier sheet bound between said covers and positioned between said front cover and a first fragrance-impregnated paper page; and a diffusion barrier sheet bound between said covers and positioned between said back cover and a last fragrance-impregnated paper page;

wherein said first and second diffusion barrier sheets are generally impermeable to oils and gases, are devoid of perforations in regions thereof intended to cover perforated regions of a protector sheet, and are fabricated from a material selected from the group consisting of polypropylene, polyethylene terephalate and metal-coated polyethylene terephalate.

8. The scrapbook of claim 7, wherein the perforations in each array are generally equidistant from one another, and each perforation is circular and generally no greater than 1 millimeter in diameter.

9. The scrapbook of claim 7, wherein said said page protector sleeves are fabricated from polymeric material selected from the group consisting of polypropylene, polyethylene terephthalate, polyethylene and plasticized polyvinyl chloride.

10. The scrapbook of claim 7, wherein aluminum is used to coat the polyethylene terephalate.

11. The scrapbook of claim 7, wherein a particular fragrance has been applied to a fragrance-impregnated page via a method selected from the group of methods consisting of spraying, rolling, painting, stamping, printing or total immersion in a fragrance bath.

* * * * *